United States Patent [19]

Fricker

[11] Patent Number: 4,729,497

[45] Date of Patent: Mar. 8, 1988

[54] SLIDE UNIT AND PARTIAL PLATE MEMBER THEREOF FOR USE IN A SLIDING CLOSURE UNIT

[75] Inventor: Robert Fricker, Unterägeri, Switzerland

[73] Assignee: Stopinc Aktiengesellschaft, Baar, Switzerland

[21] Appl. No.: 842,807

[22] Filed: Mar. 21, 1986

[30] Foreign Application Priority Data

Apr. 10, 1985 [DE] Fed. Rep. of Germany ..... 3512796

[51] Int. Cl.[4] ..... B22D 41/08

[52] U.S. Cl. ..... 222/600; 266/271; 251/367

[58] Field of Search ..... 222/591, 594, 597, 600, 222/561; 266/236, 271; 251/326, 367, 366

[56] References Cited

U.S. PATENT DOCUMENTS 4,327,847 5/1982 Tinnes ..... 222/600 X
4,415,103 11/1983 Shapland et al. ..... 222/590
4,554,035 11/1985 Stein et al. ..... 222/600 X

FOREIGN PATENT DOCUMENTS 2146677 3/1972 Fed. Rep. of Germany .

*Primary Examiner*—Joseph J. Rolla
*Assistant Examiner*—Nils Pedersen
*Attorney, Agent, or Firm*—Wenderoth, Lind & Ponack

[57] ABSTRACT

A slide unit for use in a sliding closure unit includes two partial movable refractory plates having respective planar surfaces. Each partial plate is surrounded circumferentially by a respective metal band. The two plates are assembled together in a frame to abut along a butt joint so that the two partial plates can be moved together with the planar surfaces thereof contacting a stationary refractory plate of a sliding closure unit. The metal bands at the area of the butt joint between the two partial plates is spanned by a refractory shoulder extending integrally from at least one of the partial plates. Such shoulder thereby extends the planar surfaces of the two plates to the butt joint so that the two planar surfaces form a continuous sealing surface.

16 Claims, 4 Drawing Figures

SLIDE UNIT AND PARTIAL PLATE MEMBER THEREOF FOR USE IN A SLIDING CLOSURE UNIT

BACKGROUND OF THE INVENTION

The present invention relates to a slide unit for use in a sliding closure unit for controlling the discharge of molten metal from a metallurgical vessel. The present invention further relates to a partial plate member of such a slide unit.

More particularly, the present invention relates to such a slide unit and partial plate member thereof wherein the slide unit includes two partial movable refractory plates having respective planar sealing surfaces and mounted together in a frame to be movable together with the sealing surfaces thereof sliding against a stationary refractory plate of a sliding closure unit, with each of the partial plates being surrounded circumferentially by a band, for example a metal band such as a sheet metal band.

The partial plates, each of which can be replaced individually, include, for example, a pouring plate having therethrough a discharge opening and a closing plate. However, it is also possible to provide two adjacent partial pouring plates which are used alternatively. It is necessary to surround each partial plate with a metal jacket or band, which can be formed as a tension band or as a component of a metal shell with a bottom area, in order to hold each respective partial plate together if cracks occur in the refractory material thereof during use.

A slide unit of the above type is disclosed in DE-OS No. 21 46 677, wherein the two partial movable refractory plates abut against one another at their circumferential bands, and edges of both bands are exposed at the top of the thus assembled plates. This arrangement can disturb the close fit of the sealing surfaces with the stationary refractory plate of the sliding closure unit during operation as a result of differing heat expansions of the refractory material of the plates and the material of the bands. Furthermore, when the plates are moved to a position such that the edges of the bands are beneath the discharge opening of the stationary refractory plate, the molten metal therein makes contact with the bands. This can result in damage to the sealing surfaces of the plates during further operation due to hardened steel which adheres to the bands, or can make more difficult a replacement of one of the partial plates due to the occurrence of a "welding together" of the edges of the abutting bands.

SUMMARY OF THE INVENTION

With the above discussion in mind, it is an object of the present invention to provide an improved slide unit of the above described type but whereby the above and other prior art disadvantages are avoided.

It is a further object of the present invention to provide such a slide unit wherein the two partial plates may be assembled together in abutment and repeatedly moved in opposite directions without the circumferential bands at the area of abutment coming in contact with the molten metal being discharged.

It is a further object of the present invention to provide a partial movable refractory plate member for use in such a slide unit.

These objects are achieved in accordance with the present invention by the provision of a slide unit including two partial movable refractory plate having respective planar sealing surfaces, each partial plate being surrounded circumferentially by a respective band, such as a metal band, the two partial plates being assembled together to abut circumferentially along a butt joint, so that the two partial plates can be moved together with the planar surfaces thereof sealing against a stationary refractory plate of a sliding closure unit, the partial plates having at least one integral refractory shoulder extending at least across the respective band in the area of the butt joint, thereby extending the planar surfaces to the butt joint so that the planar surfaces of the two partial plates form a continuous sealing surface. By the formation of such a continuous sealing surface over both partial plates, molten metal being discharged cannot come in contact with the circumferential bands of the two partial plates, thereby avoiding difficulties resulting from such contact and assuring a smooth operation.

In accordance with a preferred arrangement, each partial plate has an integral refractory shoulder extending across the thickness of the respective band, the two shoulders of the partial plates abutting to form the butt joint.

Preferably, the butt joint is rectilinear, and in a further preferred arrangement each partial plate is of substantially rectangular configuration, and the butt joint is formed between respective rectilinear short sides of the two partial plates.

In accordance with one arrangement of the present invention, the width or height of the band is reduced in the area of the shoulder, and the shoulder has a thickness no more than approximately half the thickness of the partial plate. This provides a favorable compromise between the remaining width of the band adjacent the shoulder and the necessary thickness of the shoulder to provide strength required for the butt joint. In accordance with another arrangement of the present invention, the band can be fitted within a groove formed around the circumference of the partial plate, the groove being defined by a pair of shoulders extending opposite planar surfaces of the partial plate. By this arrangement, the band may be of a continuous width throughout its circumference.

BRIEF DESCRIPTION OF THE DRAWINGS

Other objects, features and advantages of the present invention will be apparent from the following detailed description of preferred embodiments thereof, with reference to the accompanying drawings, wherein.

DETAILED DESCRIPTION OF THE INVENTION

Figure 1:
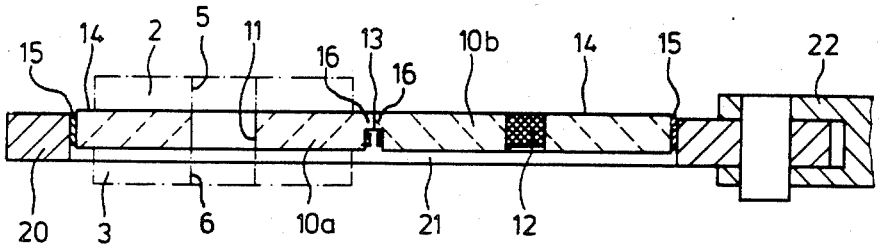
FIG. 1 is a longitudinal sectional view through a slide unit according to a first embodiment of the present invention.
Figure 2:
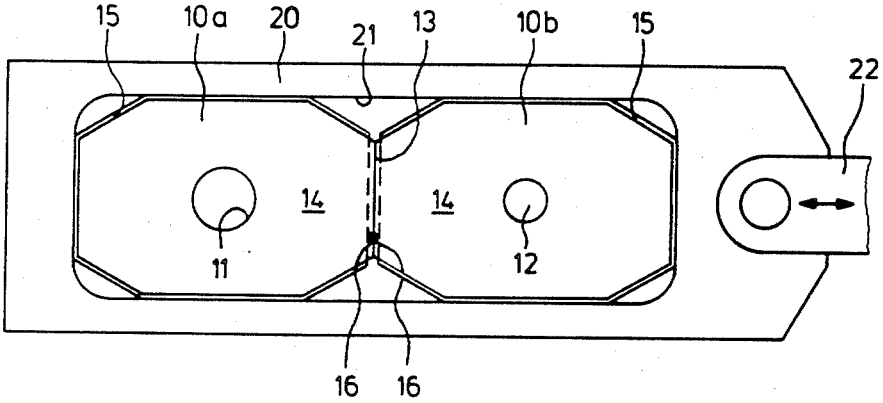
FIG. 2 is a plan view thereof.

In FIGS. 1 and 2 is shown a slide unit according to a first embodiment of the present invention and illustrated as being employed with a so-called three-plate sliding closure unit employed for regulating the discharge of molten metal from a metallurgical vessel, for example in a continuous steel casting system. The overall structure of the sliding closure unit is not important in the present context, since it is contemplated that the slide unit of the present invention be employed in any compatible conventional such sliding closure unit. In FIG. 1 are shown by dashed lines upper and lower spaced stationary refractory plates 2, 3 having therethrough respective discharge openings 5, 6. The slide unit of the present invention is employable to regulate the discharge of molten metal from a vessel and through discharge openings 5, 6.

The slide unit includes a rectangular frame 20 having therein an opening 21 and supporting therein two partial movable refractory plates 10*a*, 10*b*. Partial plate 10*a* has therethrough a discharge opening 11 which is brought into and out of alignment with discharge openings 5, 6 and which thus forms a pouring plate. Partial plate 10*b* is a closing plate, i.e. is adapted to close discharge opening 5 in the closed position of the sliding closure unit. The slide unit is moved back and forth in the direction of the double-headed arrow shown in FIG. 2 in a known manner via a power driven connecting rod 22 articulated to frame 20. By such movement, the two partial plates 10*a*, 10*b* located adjacent to one another in frame opening 21 are guided so that they move jointly between stationary refractory plates 2, 3. Each of the two partial plates 10*a*, 10*b* has an upper surface in the form of a planar sealing surface 14 which faces upper stationary refractory plate 2. In the arrangement shown schematically in FIG. 1, the lower surface of each partial plate also has a planar sealing surface sliding against lower stationary refractory plate 3. It is to be understood however that the slide unit of the present invention may be employed in sliding closure units having only a single, upper stationary refractory plate. In the illustrated arrangement, closing plate 10*b* has therein a porous insert 12 at a location to be aligned with discharge opening 5 in the closed position of the sliding closure unit, thereby making it possible to supply a gas into the discharge conduit when the sliding closure unit is closed. Such however is not a necessary feature of the present invention. Thus, the slide unit of the present invention can either completely open, partially open (throttle) or entirely close, in a known manner, the discharge opening from the metallurgical vessel.

Each of the partial plates 10*a*, 10*b* is surrounded circumferentially by a respective band 15, for example a metal band such as formed by sheet metal. Such bands hold the partial plates together if cracks occur in the refractory material thereof as a result of the extreme and alternating effects of heat during use. Due to the provision of separate partial plates for the pouring plate 10*a* and the closing plate 10*b*, it is possible to replace such partial plates separately, and this is of advantage since the pouring plate 10*a* requires replacement much more frequently than closing plate 10*b*, particularly during throttled discharge. Thus, the partial plate 10*a* readily can be replaced when the slide unit is in a position with partial plate 10*b* closing discharge opening 5.

The operation of the sliding closure unit normally requires repeated alternating movements between the open or throttle position and the closed position in opposite directions. A butt joint 13 present between the two partial plates therefore must pass beneath the molten metal existing or standing in discharge opening 5 of upper stationary refractory plate 2. In order to ensure that such movement can occur smoothly and repeatedly without causing the prior art disadvantages discussed above, it is necessary for butt joint 13 to be constructed in accordance with the present invention.

Thus, at least one of the partial plates has an integral refractory shoulder extending across at least the respective band 15 at the area of butt joint 13. In the arrangement illustrated in FIGS. 1 and 2, plates 10*a*, 10*b* each have extended shoulders 16 extending across the respective bands 15. By this arrangement, the planar surfaces 14 of the two plates are extended to the butt joint 13 so that the planar surfaces 14 of the two plates form a continuous sealing surface. The two shoulders 16 thus are in abutment and define butt joint 13.

Figure 3:
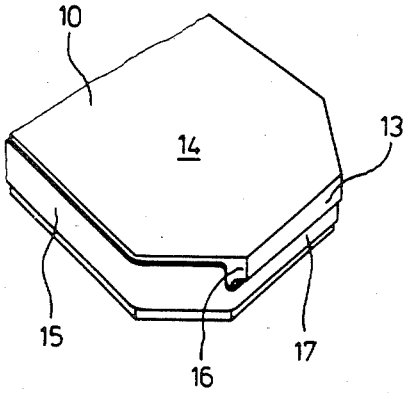
FIG. 3 is a perspective view of a portion of one partial plate thereof.

As shown particularly in FIG. 3, the width or height of each band 15 is reduced at a section 17 thereof corresponding to the respective shoulder 16. That is, band 15 essentially has formed therein a recess through which extends shoulder 16. To obtain sufficient strength of band 15 on the one hand, and to achieve a sufficient area of abutment of shoulders 16 to form butt joint 13 on the other hand, the thickness of shoulder 16 should not be more than approximately half of the thickness of the respective partial plate.

Further, in the arrangement illustrated, each of the partial plates has a substantially rectangular configuration, although the corners thereof are shown removed for purposes not pertinent to the present discussion. The butt joint 13 is formed along rectilinear short sides of each of the rectangular partial plates.

By the above described arrangements, it is ensured that molten metal being discharged never comes in direct contact with metallic members of the sliding closure unit, particularly the metal bands 15. Thereby, bands 15 perform their intended function without the above discussed prior art disadvantages. By the above arrangement of the partial plates within frame 20, and as a consequence of the friction of the partial plates suppressed between stationary refractory plates 2, 3, butt joint 13 constantly remains tightly closed in both directions of movement of the slide unit.

Figure 4:
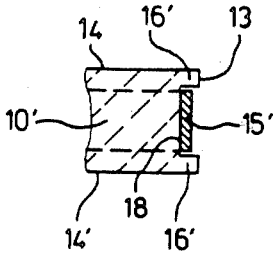
FIG. 4 is a partial sectional view illustrating a second embodiment of the present invention.

In the modified embodiment shown in FIG. 4, the circumference of partial plate 10' has formed therein a groove 18 into which extends the respective band 15'. Groove 18 is defined by a pair of shoulders 16' which extend opposite planar sealing surfaces 14, 14' of partial plate 10'. The butt joint between two such partial plates then is formed by abutments of the two shoulders 16' of each partial plate. In accordance with this embodiment of the present invention, the band 15' may have a uniform height or width around the entire circumference of the partial plate. This embodiment offers the further advantage that the partial plate may be reversed so that either of planar sealing surfaces 14, 14' may be mounted in sliding contact with upper stationary refractory plate 2, as desired.

Although the present invention has been described and illustrated with respect to preferred features thereof, it is to be understood that various modifications may be made to the specifically described and illustrated features without departing from the scope of the present invention.

I claim:

1. A slide unit for use in a sliding closure unit for controlling the discharge of molten metal from a metallurgical vessel, said slide unit comprising:

a slide frame having therein an opening;

two partial movable refractory plates fixedly mounted in said opening and having respective planar surfaces, each said partial plate being surrounded circumferentially by a respective band, at least a first said partial plate having therethrough a discharge opening;

said two partial plates being assembled together to abut circumferentially along a butt joint, so that said two partial plates can be moved together with said planar surfaces thereof adapted to seal against a stationary refractory plate of the sliding closure unit to bring said discharge opening into the out of alignment with a discharge opening of the stationary refractory plate; and means for extending said planar surfaces across both said bands at said butt joint so that said planar surfaces of said two partial plates form a continuous sealing surface preventing contact of molten metal with said bands during movement of said two partial plates, said means comprising a refractory shoulder formed integrally with at least one said partial plate and extending therefrom into abutment with a refractory portion of the other said plate, thereby forming said butt joint.

2. A slide unit as claimed in claim 1, wherein each said partial plate has an integral said refractory shoulder extending across the thickness of the respective said sand, said shoulders of said two partial plates abutting to form said butt joint.

3. A slide unit as claimed in claim 1, wherein said butt joint is rectilinear.

4. A slide unit as claimed in claim 3, wherein each said partial plate is of substantially rectangular configuration, and said butt joint is formed between respective short sides of said two partial plates.

5. A slide unit as claimed in claim 1, wherein circumferential portions of said one partial plate, other than said integral shoulder thereof, are not extended across the thickness of the respective said band.

6. A partial movable refractory plate member for use in a slide unit of a sliding closure unit for controlling the discharge of molten metal from a metallurgical vessel, said member comprising:

a refractory partial plate having a planar sealing surface and a circumference including a rectilinear section;

a band surrounding said circumference of said partial plate; and an integral refractory shoulder extending from said partial plate, along said rectilinear section and across and beyond the thickness of said band, thereby extending said sealing surface across and beyond said band.

7. A member as claimed in claim 6, wherein said partial plate is of substantially rectangular configuration, and said shoulder extends from a short side thereof.

8. A member as claimed in claim 6, wherein said band has a recess through which extends said shoulder, and said shoulder has a thickness no more than half the thickness of said partial plate.

9. A member as claimed in claim 6, wherein said band is fitted within a groove formed in said circumference of said partial plate, said groove being defined by a pair of said shoulders extending opposite planar surfaces of said partial plate.

10. A member as claimed in claim 6, wherein circumferential portions of said partial plate, other than said integral refractory shoulder thereof, are not extended across the thickness of said band.

11. A partial movable refractory plate member for use in a slide unit of a sliding closure unit for controlling the discharge of molten metal from a metallurgical vessel, said member comprising:

a refractory partial plate having a planar sealing surface and a circumference including a rectilinear section;

a band surrounding said circumference of said partial plate;

an integral refractory shoulder extending from said partial plate, along said rectilinear section and across the thickness of said band, thereby extending said sealing surface across said band, said band having a recess through which extends said shoulder, said shoulder having a thickness no more than half the thickness of said partial plate; and circumferential portions of said partial plate, other than said integral refractory shoulder thereof, not extending across the thickness of the band.

12. A member as claimed in claim 11, wherein said partial plate is of substantially rectangular configuration, and said shoulder extends from a short side thereof.

13. A slide unit for use in a sliding closure unit for controlling the discharge of molten metal from a metallurgical vessel, said slide unit comprising:

two partial movable refractory plates having respective planar surfaces, each said partial plate being surrounded circumferentially by a respective band, at least a first said partial plate having therethrough a discharge opening;

said two partial plates being assembled together to abut circumferentially along a butt joint, so that said two partial plates can be moved together with said planar surfaces thereof adapted to seal against a stationary refractory plate of the sliding closure unit to bring said discharge opening into and out of alignment with a discharge opening of the stationary refractory plate; and means for extending said planar surfaces across both said bands at said butt joint so that said planar surfaces of said two partial plates form a continuous sealing surface preventing contact of molten metal with said bands during movement of said two partial plates, said means comprising a refractory shoulder formed integrally with at least one said partial plate and extending therefrom into abutment with a refractory portion of the other said plate, thereby forming said butt joint, said band of said one partial plate having a recess through which extends said shoulder, and said shoulder having a thickness no more than half the thickness of the respective said partial plate.

14. A slide unit for use in a sliding closure unit for controlling the discharge of molten metal from a metallurgical vessel, said slide unit comprising:

two partial movable refractory plates having respective planar surfaces, each said partial plate being surrounded circumferentially by a respective band, at least a first said partial plate having therethrough a discharge opening;

said two partial plates being assembled together to abut circumferentially along a butt joint, so that said two partial plates can be moved together with said planar surfaces thereof adapted to seal against a stationary refractory plate of the sliding closure unit to bring said discharge opening into and out of alignment with a discharge opening of the stationary refractory plate; and means for extending said planar surfaces across both said bands at said butt joint so that said planar surfaces of said two partial plates form a continuous sealing surface preventing contact of molten metal with said bands during movement of said two partial plates, said means comprising a refractory shoulder formed integrally with at least one said partial plate and extending therefrom into abutment with a refractory portion of the other said plate, thereby forming said butt joint, said band of said one partial plate being fitted within a circumferential groove formed in said one partial plate, said groove being defined by a pair of said shoulders extending opposite planar surfaces of said one partial plate.

15. A slide unit for use in a sliding closure unit for controlling the discharge of molten metal from a metallurgical vessel, said slide unit comprising:

two partial movable refractory plates having respective planar surfaces, each said partial plate being surrounded circumferentially by a respective band, at least a first said partial plate having therethrough a discharge opening;

said two partial plates being assembled together to abut circumferentially along a butt joint, so that said two partial plates can be moved together with said planar surfaces thereof adapted to seal against a stationary refractory plate of the sliding closure unit to bring said discharge opening into and out of alignment with a discharge opening of the stationary refractory plate; and means for extending said planar surfaces across both said bands at said butt joint so that said planar surfaces of said two partial plates form a continuous sealing surface preventing contact of molten metal with said bands during movement of said two partial plates, said means comprising a refractory shoulder formed integrally with at least one said partial plate and extending therefrom into abutment with a refractory portion of the other said plate, thereby forming said butt joint, said refractory shoulder extending from said one partial plate by a distance greater than the thickness of the respective said band and abutting with said refractory portion of said other plate at a position such that said bands are spaced from each other and not in abutment.

16. A partial movable refractory plate member for use in a slide unit of a sliding closure unit for controlling the discharge of molten metal from a metallurgical vessel, said member comprising:

a refractory partial plate having opposite planar sealing surfaces and a circumference including a rectilinear section;

a band surrounding said circumference of said partial plate and fitting within a groove formed in said circumference thereof;

a pair of integral refractory shoulders defining said groove and extending from said partial plate, along said rectilinear section and across the thickness of said band, thereby extending said opposite planar sealing surfaces across said band; and circumferential portions of said partial plate, other than said integral refractory shoulders thereof, not extending across the thickness of said band.

* * * * *